US011434888B2

(12) United States Patent
Kim et al.

(10) Patent No.: US 11,434,888 B2
(45) Date of Patent: Sep. 6, 2022

(54) COMPRESSOR HAVING OIL GUIDE PATH

(71) Applicant: LG Electronics Inc., Seoul (KR)

(72) Inventors: Younghwan Kim, Seoul (KR); Seungwook Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/574,967

(22) Filed: Sep. 18, 2019

(65) Prior Publication Data

US 2020/0088180 A1 Mar. 19, 2020

(30) Foreign Application Priority Data

Sep. 18, 2018 (KR) ..... 10-2018-0111211

(51) Int. Cl.
*F04B 39/02* (2006.01)
*F04B 53/18* (2006.01)
(Continued)

(52) U.S. Cl.
CPC ..... *F04B 39/0246* (2013.01); *F04B 35/01* (2013.01); *F04B 35/04* (2013.01);
(Continued)

(58) Field of Classification Search
CPC ..... F04B 39/0246; F04B 35/04; F04B 39/02; F04B 39/0261; F04B 53/18; F04B 49/225;
(Continued)

(56) References Cited

U.S. PATENT DOCUMENTS 6,478,116 B1 * 11/2002 Klausen ..... F04B 39/0261 184/31
2010/0158711 A1 * 6/2010 Yagi ..... F04B 39/0061 417/312
(Continued)

FOREIGN PATENT DOCUMENTS

CN 1712724 12/2005
CN 201786660 4/2011
(Continued)

OTHER PUBLICATIONS

Extended European Search Report in EP Patent Application No. 19197755.2, dated Dec. 16, 2019, 8 pages.
CN Office Action in Chinese Appln. No. 201910882770.6, dated Mar. 29, 2021, 12 pages (with English translation).
KR Notice of Allowance in Korean Application No. 10-2018-0111211, dated Feb. 26, 2020, 1 page.

*Primary Examiner* — Bryan M Lettman
(74) *Attorney, Agent, or Firm* — Fish & Richardson P.C.

(57) ABSTRACT

A compressor includes: a driving unit including a stator, a rotor, and a rotary shaft provided in the rotor, having an oil guide path formed at an inner side in a radius direction; a compression unit coupled to the rotary shaft, having a cylinder and a piston reciprocating in the cylinder by a driving force of the driving unit; and an oil supply unit coupled to a lower end of the rotary shaft, supplying oil toward the compression unit. The oil supply unit includes a rotary portion for supplying oil toward the oil guide path while being rotated together with the rotary shaft and a fixed portion having an inner space partitioned to accommodate at least a portion of the rotary portion, and the oil guide path is formed to pass through the rotary shaft along a length direction.

20 Claims, 7 Drawing Sheets

(51) Int. Cl.

| | |
|---|---|
| ***F04B 35/04*** | (2006.01) |
| ***F04B 49/22*** | (2006.01) |
| ***F04B 41/06*** | (2006.01) |
| ***F04B 35/01*** | (2006.01) |
| ***F04C 15/00*** | (2006.01) |
| ***F04C 2/10*** | (2006.01) |
| ***F04C 11/00*** | (2006.01) |

(52) U.S. Cl.
CPC ..... *F04B 39/0276* (2013.01); *F04B 39/0284* (2013.01); *F04B 41/06* (2013.01); *F04B 49/225* (2013.01); *F04B 53/18* (2013.01); *F04C 2/10* (2013.01); *F04C 11/005* (2013.01); *F04C 15/0065* (2013.01); *F04C 15/0073* (2013.01); *F04C 15/0076* (2013.01)

(58) Field of Classification Search
CPC ..... F04B 41/06; F04B 35/01; F04B 39/0284; F25B 31/002; F25B 31/004; F04C 15/0065; F04C 15/0076; F04C 2/10; F04C 15/0073; F04C 11/005; F16N 7/366; F16N 13/20
See application file for complete search history.

(56) References Cited

U.S. PATENT DOCUMENTS

| | | | | |
|---|---|---|---|---|
| 2011/0232416 | A1* | 9/2011 | Kim | F04B 53/147 74/605 |
| 2011/0265510 | A1* | 11/2011 | Kim | F04B 27/0423 62/498 |
| 2015/0030487 | A1* | 1/2015 | Toyama | F04C 18/02 418/55.1 |
| 2017/0204753 | A1* | 7/2017 | Sacomori | F16N 7/366 |
| 2018/0223850 | A1* | 8/2018 | Toyama | F04C 27/009 |
| 2019/0024650 | A1* | 1/2019 | Lee | F04B 39/0246 |

FOREIGN PATENT DOCUMENTS

| | | |
|---|---|---|
| EP | 3514383 | 7/2019 |
| JP | 2012219654 | 11/2012 |
| JP | 5863436 | 2/2016 |
| KR | 100274619 | 1/2001 |
| KR | 20070093640 | 9/2007 |
| KR | 1020180100903 | 9/2018 |

* cited by examiner

COMPRESSOR HAVING OIL GUIDE PATH

CROSS-REFERENCE TO RELATED APPLICATIONS

This application claims the benefit of the Korean Patent Application No. 10-2018-0111211, filed on Sep. 18, 2018, which is hereby incorporated by reference as if fully set forth herein.

BACKGROUND OF THE INVENTION

Field of the Invention

The present invention relates to a compressor, and more particularly, to a reciprocating compressor that enables stable oil supply.

Discussion of the Related Art

A compressor is an apparatus that compresses a fluid to enhance a pressure. Examples of a compressor for compressing a fluid include a reciprocating compressor for compressing a fluid, which is sucked in a cylinder, through a piston, and a scroll compressor for compressing a fluid by relatively rotating two scrolls.

The compressor is provided with a rotary shaft that provides a force for compressing a fluid. Since the compressor is provided with a plurality of mechanical elements mutually causing friction, it is required to lubricate the mechanical elements.

For example, an oil supply unit may be provided at a bottom of the rotary shaft. The oil supply unit may be rotated by rotation of the rotary shaft, and oil stored in a lower portion of a case may be supplied to an upper side of the rotary shaft through the oil supply unit.

Generally, in the compressor of the related art, the oil supply unit is formed in a cylinder shape, and a spiral shaped oil supply path is formed on an outer circumference surface of the oil supply unit.

Meanwhile, since the oil supply unit is pressed in the bottom of the rotary shaft, if a slip occurs between the oil supply unit and the rotary shaft, rotation of the oil supply unit is restricted, whereby a problem occurs in that oil may not be supplied stably.

In addition, in the compressor of the related art, since the oil supply path is formed on the outer circumference surface of the oil supply unit, problems occur in that oil may be dispersed in the middle of oil supply, and it is difficult to concentrate oil supply on an element, such as a piston, which has high friction and radiation.

SUMMARY OF THE INVENTION

Accordingly, the present invention is directed to a compressor that substantially obviates one or more problems due to limitations and disadvantages of the related art.

An object of the present invention is to provide a reciprocating compressor that may stably supply oil by preventing a slip between a rotary shaft and an oil supply unit from occurring.

Another object of the present invention is to provide a reciprocating compressor in which an oil supply path is formed inside a rotary shaft to avoid dispersion of oil, which may be generated in the middle of oil supply.

Still another object of the present invention is to provide a reciprocating compressor in which oil may intensively and stably be supplied to an element such as a piston that requires concentrated supply of oil.

To this end, the present invention suggests that a trochoid oil supply structure should be applied to an oil supply structure of a reciprocating compressor. In this way, if the trochoid oil supply structure is applied to the oil supply structure of the reciprocating compressor, much oil may be supplied even at low driving and low viscosity oil.

In the present invention, either a step having a diameter greater than an inner diameter of a shaft or an insertion stopper may be formed in an inner gear so as not to generate mutual interference between an oil supply unit and the shaft.

Also, a sliding prevention structure formed to be eccentric from a gear center may be inserted to an oil path of the shaft and restricted in a rotation direction, whereby a gear may be rotated at the same rotation speed as that of the shaft even in the state that the sliding prevention structure is not pressed.

The present invention suggests a shaft path structure for suppressing impact of a case due to oil dispersion during high speed driving and intensively supplying oil to a cylinder.

To this end, the present invention comprises an oil supply unit coupled to a lower end of a rotary shaft, supplying oil toward a compression unit of a compressor, wherein the oil supply unit includes a rotary portion for supplying oil toward an oil guide path while being rotated together with the rotary shaft, and a fixed portion having an inner space partitioned to accommodate at least a portion of the rotary portion, and the oil guide path may be formed to pass through the rotary shaft along a length direction.

As a more detailed example, to achieve these objects and other advantages and in accordance with the purpose of the invention, as embodied and broadly described herein, a compressor according to the present invention comprises a driving unit including a stator, a rotor, and a rotary shaft provided in the rotor, having an oil guide path formed at an inner side in a radius direction; a compression unit coupled to the rotary shaft, having a cylinder and a piston reciprocating in the cylinder by a driving force of the driving unit; and an oil supply unit coupled to a lower end of the rotary shaft, supplying oil toward the compression unit, wherein the oil supply unit includes a rotary portion for supplying oil toward the oil guide path while being rotated together with the rotary shaft and a fixed portion having an inner space partitioned to accommodate at least a portion of the rotary portion, and the oil guide path is formed to pass through the rotary shaft along a length direction.

In this case, a coupling space in which a portion of the rotary portion is pressed may be formed at an inner side in a radius direction of a lower end of the rotary shaft, the oil guide path may include a first path extended from the coupling space to an upper side, and a second path extended from the first path to the upper side, and the second path may be extended to an upper end of the rotary shaft and formed to be inclined toward the piston.

Since the oil is guided through the inner side of the rotary shaft, loss and dispersion of the oil may be avoided.

The first path may be formed to be eccentric from the center in a radius direction of the rotary shaft. The rotary portion may include a shaft coupling portion pressed in the coupling space and a first extension portion extended from an upper end of the shaft coupling portion into the first path.

Therefore, a slip between an inner circumference surface partitioning the coupling space of the rotary shaft and the shaft coupling portion may be avoided by the first extension portion.

The first extension portion may be eccentric from the center in a radius direction of the rotary portion to correspond to the first path.

The first extension portion may include a first outer circumference surface of a semi-circle shape, which adjoins a portion of an inner circumference surface of the first path, and a second outer circumference surface provided at an opposite side of the first outer circumference surface, facing the other portion of the inner circumference surface of the first path.

The second outer circumference surface may be recessed toward the first outer circumference surface. Also, the second outer circumference surface may have a curvature smaller than that of the first outer circumference surface.

The first path may be provided with a divergence path for guiding oil toward a bearing that supports the rotary shaft.

The divergence path may be provided at a height of a middle length or more of the first path, and an upper end of the first extension portion may be arranged below the divergence path.

The rotary shaft may include a base shaft connected to the rotor, a rotary plate provided at an upper side of the base shaft, and an eccentric shaft provided at an upper side of the rotary plate. The piston and the eccentric shaft may be connected with each other through a connecting rod.

The coupling space and the first path may be formed to up and down pass through an inner side in a radius direction of the base shaft.

The second path may be formed to up and down pass through an inner side in a radius direction of the eccentric shaft and the rotary plate.

An oil discharge hole may be formed at an upper end of the eccentric shaft, and the second path may be communicated with the oil discharge hole.

The second path may include a flow velocity enhancement portion extended from an upper end of the first path, having a diameter smaller than that of the first path, and an oil pressure enhancement portion extended from an upper end of the flow velocity enhancement portion, having a diameter greater than that of the flow velocity enhancement portion.

The rotary portion may further include a second extension portion extended from the first extension portion and extended from an upper end of the shaft coupling portion to an inner side of the coupling space. In this case, an upper end of the second extension portion may adjoin an upper surface of the coupling space.

The second extension portion may be arranged to face the first extension portion.

The fixed portion may be provided with a through hole through which the shaft coupling portion passes, and a step difference portion protruded to an outer side in a radius direction of the shaft coupling portion and fitted into the through hole may be provided at the lower end of the shaft coupling portion. In this case, the lower end of the rotary shaft may adjoin an upper surface of the step difference portion.

A side of the step difference portion may adjoin an inner circumference surface. The step difference may have a height greater than a thickness of the upper surface of the second fixed portion provided with the through hole.

The rotary portion may include a first rotary portion arranged at a lower side of the step difference portion, having a first gear body, and a second rotary portion arranged to surround an outer side of the first rotary portion, having a second gear body engaged with the first gear body.

The fixed portion may include a first fixed portion provided with the through hole, and a second fixed portion coupled to the first fixed portion, partitioning an inner space for accommodating the first rotary portion and the second rotary portion.

The second fixed portion may include an oil inlet passing through a bottom surface of the second fixed portion in an up and down direction and an oil chamber for guiding oil entering there through the oil inlet, pressed between the first gear body and the second gear body, to an oil outlet formed at an inner side of the shaft coupling portion.

A profile of first gear teeth provided in the first gear body and second gear teeth provided in the second gear body may be a trochoid shape, and a space portion communicated with the oil inlet may be provided between the first gear teeth and the second gear teeth.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
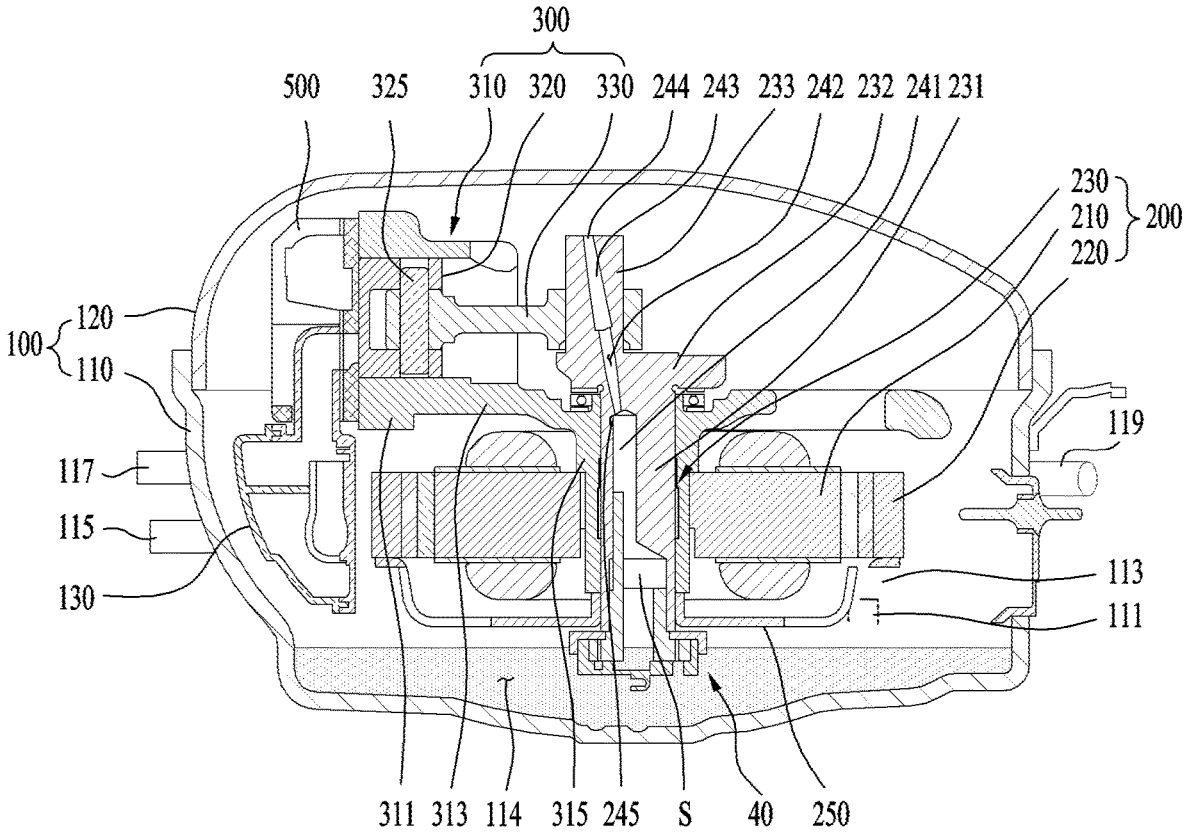
FIG. 1 is a sectional view illustrating a structure of a compressor according to the present invention.

Hereinafter, a reciprocating compressor according to the present invention will be described in detail with reference to the accompanying drawings. It is to be understood that the accompanying drawings show an exemplary embodiment of the present invention, and are not intended to restrict the scope of the present invention but intended to describe the present invention in detail.

Also, wherever possible, the same reference numbers will be used throughout the drawings to refer to the same or like parts. For convenience of description, size and shape of each element member shown in the drawings may be enlarged or downsized.

FIG. 1 is a sectional view illustrating a structure of a compressor according to the present invention.

Referring to FIG. 1, the compressor 10 according to the present invention may be a reciprocating compressor.

The compressor 10 may include a case 100 forming an external appearance. Elements of the compressor 10 may be provided in the case 100. The case 100 may include a lower case 110 and an upper case 120 coupled to the lower case 110 at an upper side of the lower case 110. The lower case 110 and the upper case 120 may be coupled with each other to be sealed.

A bump 111 is provided at the bottom in an inner space of the case 100. That is, the bump 111 may be provided at the bottom inside the case 110. The bump 111 fixes an elastic body 113 such as a coil spring. A cylinder block which will be described later may be supported above the elastic body 113. Therefore, the elastic body 113 prevents vibration of the cylinder block from being delivered to the case 100.

The case 100 may be provided with a suction pipe 115, a discharge pipe 117 and a process pipe 119. For example, the pipes may be provided in the case 110.

The suction pipe 115 is to allow a fluid to enter the inside of the case 100, and may be provided to pass through the lower case 110 or formed in a single body with the lower case 110. In the following description, the fluid may mean a gas or vapor refrigerant.

The fluid entering the suction pipe 115 may enter a compression space inside a cylinder, which will be described later, through a suction muffler 130.

The discharge pipe 117 is an element for discharging the compressed fluid to the outside of the case 100, and may be configured to be communicated with the compression space inside the compressed cylinder. The discharge pipe 117 may be provided to pass through the lower case 110 or may be formed in a single body with the lower case 110.

For example, the discharge pipe 117 may be communicated with the compression space through a discharge hose which is not shown. In the shown embodiment, the compressed fluid may be guided to the discharge pipe 117 by passing through a discharge space 500 independently provided outside a compression unit which will be described later. The discharge space 500 is an element for attenuating pulsation of a fluid which is discharged. Since the discharge space 500 is already known in the art, its detailed description will be omitted.

The process pipe 119 is to charge a refrigerant in the case 100 after sealing the inside of the case 100, and may be provided to pass through the lower case 110 in the same manner as the suction pipe 120 and the discharge pipe 130.

The compressor 10 may include a driving unit 200 for providing a driving force, a compression unit 300 driven by the driving unit 200, for compressing the fluid, and an oil supply unit 40 formed to supply oil to various frictional surfaces existing in the driving unit 200 an the compression unit 300. For example, the frictional surfaces may be between an outer circumference surface of a piston, which will be described later, and an inner circumference surface of a cylinder, and between an outer circumference surface of a rotary shaft and an inner circumference surface of a bearing. The driving unit 200 may be an electric motor.

The driving unit 200 may include a stator 210, a rotor 220, and a rotary shaft 230 connected to the rotor 220.

The stator 210 may be fixedly provided in the case 100. The rotor 210 may be arranged to surround the stator 210 at the outside in a radius direction of the stator 210.

The rotary shaft 230 may be connected to the rotor 220 through a connection member 250. For example, the connection member 250 may be formed in a ring shape, and an outer end in a radius direction of the connection member 250 may be connected to a lower end of the rotor 220, and an inner end in a radius direction of the connection member 250 may be connected to a lower end of the rotary shaft 230.

Therefore, a rotary force of the rotor 220 may be delivered to the rotary shaft 230 through the connection member 250. That is, the rotary shaft 230 may be rotated together with the rotor 220 when the rotor 220 is rotated.

In detail, the rotary shaft 230 may include a base shaft 231, a rotary plate 232 provided on an upper end of the base shaft 231, and an eccentric shaft 233 provided on an upper end of the rotary plate 232.

The base shaft 231, the rotary plate 232 and the eccentric shaft 233 may be formed in a single body. Unlike this case, the base shaft 231, the rotary plate 232 and the eccentric shaft 233 may be manufactured separately and then coupled with one another.

The base shaft 231 may be coupled to a bearing which will be described later. The inner end in a radius direction of the connection member 250 may be fixed to the lower end of the base shaft 231. The base shaft 231 may be rotated together with the rotor 220.

The rotary plate 232 may rotatably be mounted on a rotary plate holder of a cylinder block which will be described later. The rotary plate 232 may be formed to be protruded in an opposite direction of an eccentric direction of the eccentric shaft 233. This is to attenuate vibration according to a reciprocating movement of the piston which will be described later.

The eccentric shaft 233 may be formed to be protruded from the upper surface of the rotary shaft 232. The eccentric shaft 233 may upwardly be provided from an eccentric position from a shaft center of the base shaft 231. Therefore, if the rotary plate 232 is rotated, the eccentric shaft 233 may be rotated eccentrically.

The compression unit 300 may include a cylinder block 310 provided at an upper side of the rotor 220, a piston 320 reciprocating inside a cylinder 311 provided in the cylinder block 310, and a connecting rod 330 for connecting the piston 320 with the aforementioned rotary shaft 230.

The cylinder block 310 may include a cylinder 311 provided at the outside in a radius direction of the cylinder block 310, and a rotary plate holder 313 extended from an outer circumference surface of one side of the cylinder 311.

For example, the cylinder 311 may be formed on a front portion of the cylinder block 310. The cylinder 311 may be formed in a cylindrical shape, and may be provided with a compression space formed at the inside. An opening may be formed at the rear end of the cylinder 311, and the piston 320 may be inserted into the compression space of the cylinder 311 through the opening.

The rotary plate holder 313 may be formed to be horizontally extended from the bottom of the cylinder 311 toward the rear end of the cylinder block 310. The rotary plate 232 may rotatably be mounted on the rotary plate holder 313.

The cylinder block 310 may further include a bearing 315 provided to allow at least a portion of the rotary shaft 230 to pass therethrough, rotatably supporting the rotary shaft 230. The bearing 315 may be formed to be downwardly extended from the rotary plate holder 313. Also, the bearing 315 may be formed such that its upper end and lower end may be opened.

For example, the base shaft 231 may pass through the bearing 315, and may rotatably be supported by the bearing 315. In detail, an opening through which the base shaft 231 may pass may be formed in the rotary plate holder 313, and the bearing 315 may downwardly be extended from the circumference of the opening.

The piston 320 may be accommodated in the cylinder 311 and reciprocate in an extension direction of the cylinder 311.

For example, the piston 320 may linearly reciprocate in a forward and backward direction (for example, horizontal direction) in the cylinder 311. The fluid entering the compression space in the cylinder 311 may be compressed in accordance with the reciprocating movement of the piston 320.

The connecting rod 330 may be formed to deliver a driving force provided from the driving unit 200 to the piston 320. That is, the connecting rod 330 may be formed to connect the piston 320 with the eccentric shaft 233.

The one end in a length direction of the connecting rod 330 may be connected to the piston 320 and the other end may be connected to the eccentric shaft 233, whereby a rotary movement of the rotary shaft 230 may be switched to a linear reciprocating movement.

The connecting rod 330 linearly reciprocates in a forward and backward direction (X-axis direction) in accordance with eccentric rotation of the eccentric shaft 233. Also, the piston 320 may linearly reciprocate in the cylinder 311 in accordance with the linear reciprocating movement of the connecting rod 330.

The compression unit 300 may further include a piston pin 325 for coupling the piston 320 with the connecting rod 330. In detail, the piston 325 may pass through the piston 320 and the connecting rod 330 in an up and down direction to connect the piston 320 with the connecting rod 330.

That is, one end in a length direction of the connecting rod 330 may be coupled to the piston 320 by the piston pin 325, and the other end may be coupled to the eccentric shaft 233 to surround an outer circumference surface of the eccentric shaft 233.

The oil supply unit 40 may be coupled to the lower end of the rotary shaft 230 and formed to supply oil toward the compression unit 300. For example, the oil supply unit 40 may be formed as a trochoid pump.

The oil supplied from the oil supply unit 40 may be guided through oil guide paths 241, 242 and 243. At this time, the oil guide paths 241, 242 and 243 may be formed to pass through the rotary shaft 230 in a length direction. That is, the oil guide paths 241, 242 and 243 may be extended along a length direction of the rotary shaft 230 inside a radius direction of the rotary shaft 230.

Since the oil supplied from the oil supply unit 40 is guided through the oil guide paths 241, 242 and 243 inside a radius direction of the rotary shaft 230, loss and dispersion of the oil may be avoided, and the oil may intensively be supplied to elements that require the oil.

Hereinafter, the structure of the oil supply unit 40 and the coupling relation between the oil supply unit 40 and the rotary shaft 230 will be described with further reference to another drawing.

Figure 2:
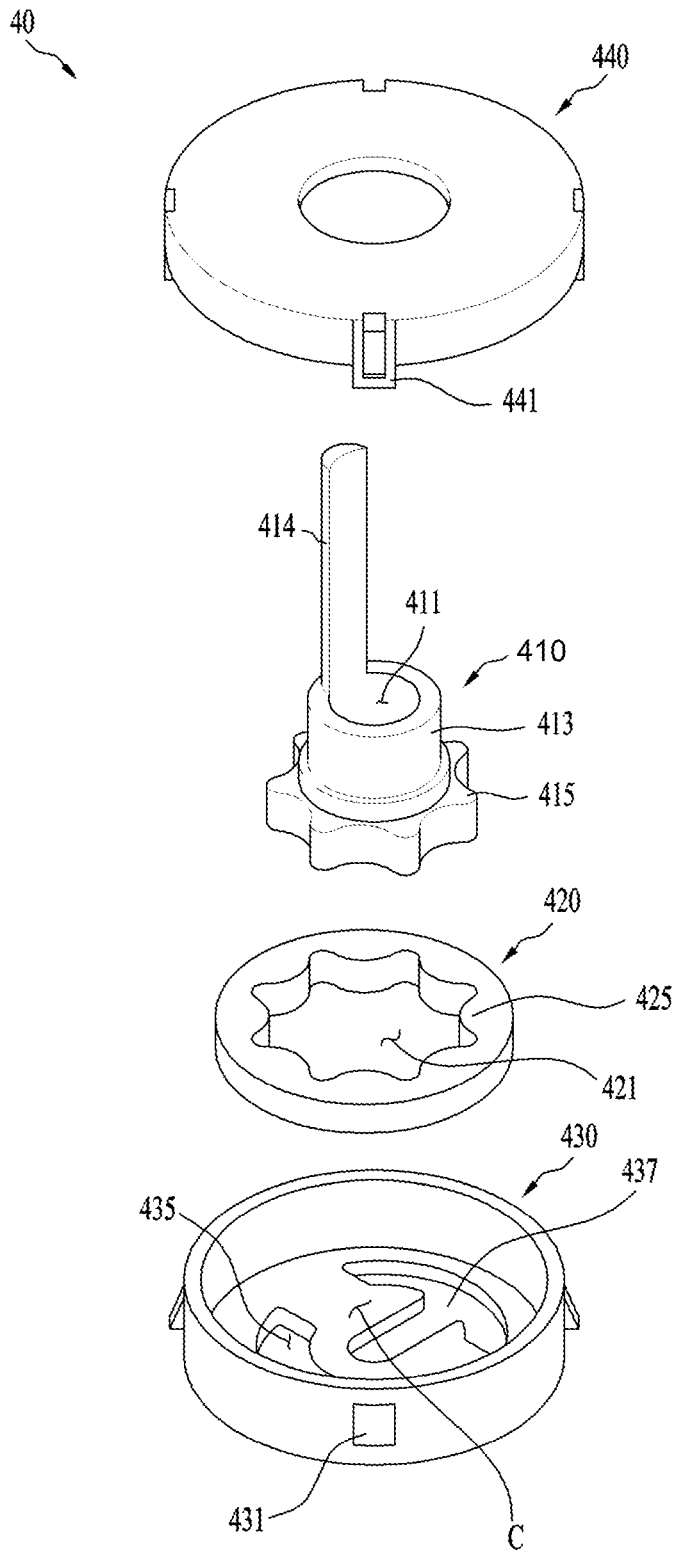
FIG. 2 is an exploded perspective view illustrating an oil supply unit provided in a compressor.

FIG. 2 is an exploded perspective view illustrating an oil supply unit provided in a compressor.

Referring to FIG. 2, the oil supply unit 40 may include rotary portions 410 and 420 for supplying oil toward the oil guide paths while being rotated together with the aforementioned rotary shaft 230, and fixed portions 430 and 440, each of which has an inner space C partitioned to accommodate at least a portion of the rotary portions 410 and 420.

The rotary portions 410 and 420 may be coupled to the lower end of the rotary shaft 230. The rotary portions 410 and 420 may supply oil toward the oil guide paths 241, 242 and 243 while being rotated together with the rotary shaft 230.

The fixed portions 430 and 440 may include a first fixed portion 430 and a second fixed portion 440 coupled to the first fixed portion 430 at an upper side of the first fixed portion 430. The inner space C may be partitioned by coupling between the first fixed portion 430 and the second fixed portion 440. For example, the first fixed portion 430 and the second fixed portion 440 may be coupled with each other such that a sidewall of the first fixed portion 430 may surround a sidewall of the second fixed portion 440.

One or more coupling bumps 431 may be provided on an outer circumference surface of the first fixed portion 430, and one or more coupling grooves 441 corresponding to the coupling bumps 431 may be provided on an outer circumference surface of the second fixed portion 440. The first fixed portion and the second fixed portion 440 may be coupled with each other by fitting of the coupling bump 431 into the coupling groove 441.

In detail, the rotary portions 410 and 420 may include a first rotary portion 410 and a second rotary portion 420 surrounding the first rotary portion 410 at the outside in a radius direction of the first rotary portion 410.

The first rotary portion 410 may include a first gear body 415 having gear teeth protruded toward the outside in a radius direction, and a second gear body 425 surrounding the outer circumference of the first gear body 415 and having gear teeth protruded toward the inside in a radius direction.

The outside of the second gear body may be formed in a circular ring shape, and may include a body accommodating portion 421 for accommodating the first gear body 415 at the center in a radius direction. The body accommodating portion 421 may be formed to pass through the second gear body 425 in an up and down direction.

The first gear teeth of the first gear body 415 and the second gear teeth of the second gear body 425 may be formed in a trochoid shape, and may be engaged with each other while partitioning a space portion which will be described later. For example, the number of the first gear teeth of the first gear body 415 may be smaller than the number of the second gear teeth of the second gear body 425.

Also, the first gear body 415 and the second gear body 425 may be accommodated in the inner space C.

The first rotary portion 410 may further include a shaft coupling portion 413 protruded from the center in a radius direction of the first gear body 415 toward the upper side. The shaft coupling portion 413 may be formed in a cylindrical shape. That is, an oil outlet 411 for upwardly supplying oil may be formed at the center in a radius direction of the shaft coupling portion 413. The oil outlet 411 may be extended along a length direction of the shaft coupling portion 413.

A through hole 445 through which the shaft coupling portion 413 passes may be formed in the second fixed portion 440. The through hole 445 may be formed at the center in a radius direction of the second fixed portion 440.

An oil accommodating portion 114 in which oil is accommodated may be provided at a lower portion in the case 100. At least a portion of the oil supply unit 40 may be arranged to be soaked in the oil accommodated in the oil accommodating portion 114. For example, the first fixed portion 430 may be arranged to be soaked in the oil accommodated in the oil accommodating portion 114.

An oil inlet 435 and an oil chamber 437 may be formed in the first fixed portion 430. The oil inlet 435 may be formed to pass through the bottom of the first fixed portion 430 in an up and down direction. Therefore, the oil accommodating portion 114 and the inner space C may be communicated with each other through the oil inlet 435.

The oil chamber 437 may be formed to be recessed at the bottom of the first fixed portion 430. The fluid entering through the oil inlet 435, pressed by the first gear body 415 and the second gear body 425 may be discharged to the oil outlet 411 by passing through the oil chamber 437.

Referring to FIGS. 1 and 2, a coupling space S where the rotary portions 410 and 420 are partially pressed may be formed at the inside in a radius direction of the rotary shaft 230. The coupling space S may be provided at the lower end of the rotary shaft 230. That is, the coupling space S may be provided at the inside in a radius direction of the lower end of the base shaft 231.

The oil guide paths 241, 242 and 243 may include a first path 241 extended from the coupling space S toward the upper side, and second paths 242 and 243 extended from the first path 241 toward the upper side.

The first path 241 may have a diameter smaller than that of the coupling space S. Therefore, the oil supplied to the coupling space S by the oil supply unit 40 may efficiently be guided through the first path 241. Also, the first path 241 may be communicated with the coupling space S and extended from the coupling space S in a vertical upward direction.

The second paths 242 and 243 may be communicated with the first path 241 and extended from the first path 241 to the upper end of the rotary shaft.

For example, an oil discharge hole 244 may be formed at the upper end of the rotary shaft 230. That is, the oil discharge hole 244 may be formed at the upper end of the eccentric shaft 233. That second paths 242 and 243 may be communicated with the oil discharge hole 244.

The second paths 242 and 243 may be formed to be inclined toward the piston 320. Therefore, the oil may intensively be supplied between the piston 320 and the cylinder 311.

The second paths 242 and 243 may include a flow velocity enhancement portion 242 extended from an upper end of the first path 241, having a diameter smaller than that of the first path 241, and an oil pressure enhancement portion 243 extended from an upper end of the flow velocity enhancement portion 242, having a diameter greater than that of the flow velocity enhancement portion 242.

A flow velocity of the oil guided through the first path 241 may be enhanced by the flow velocity enhancement portion 242.

Also, the diameter of the flow velocity enhancement portion 243 may be smaller than that of the first path 241. The oil pressure enhancement portion 243 may be formed to have a diameter gradually reduced toward the oil discharge hole 244. A discharge pressure of the oil may be enhanced in the oil pressure enhancement portion 243.

The first path 241 may be formed to be eccentric from the center in a radius direction of the rotary shaft 230. Therefore, the oil supplied to the coupling space S of the rotary shaft 230 by the oil supply unit 40 may actively enter the first path 241 by means of a centrifugal force based on rotation of the rotary shaft 230.

Meanwhile, if a slip occurs between the inner circumference surface of the rotary shaft 230 partitioning the coupling space S and the shaft coupling portion 413, it may be difficult to normally deliver the rotary force of the rotary shaft 230 to the aforementioned rotary portions 410 and 420.

In order to prevent a slip between the rotary shaft 230 and the shaft coupling portion 413 from occurring, the rotary portions 410 and 420 may include a first extension portion 414 extended from the upper end of the shaft coupling portion 413 into the first path 241.

In detail, the first rotary portion 410 may include a first extension portion 414. The first extension portion 414 may be extended from the upper end (or upper surface) of the shaft coupling portion 413 toward an upward direction at a preset length. The first extension portion 414 may be inserted into the first path 214.

That is, the first extension portion 414 may be eccentric from the center in a radius direction of the rotary portions 410 and 420 to correspond to the first path 214. In other words, the first extension portion 414 may be eccentric from the center in a radius direction of the shaft coupling portion 413.

Therefore, the rotary force of the rotary shaft 230 may efficiently be delivered to the aforementioned rotary portions 410 and 420 without the slip between the rotary shaft 230 and the shaft coupling portion 413.

Hereinafter, an operation system of the oil supply unit 40 will be described in more detail with reference to another drawing.

Figure 3:
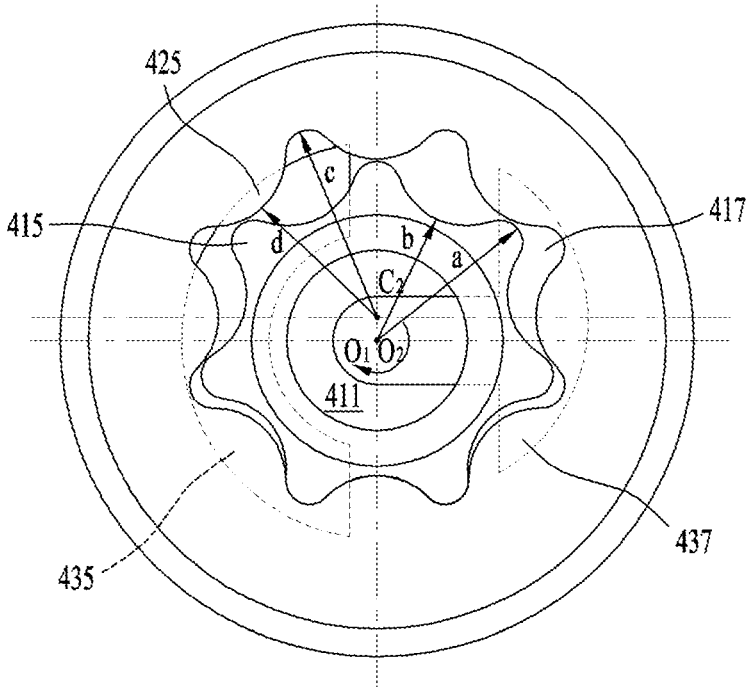
FIG. 3 is a cross-sectional view taken along line I-I of FIG. 1.

FIG. 3 is a cross-sectional view taken along line I-I of FIG. 1.

As described above, the first rotary portion 410 and the second rotary portion 420 may be rotated in a state that they are accommodated in the inner space C of the fixed portions 430 and 440. A rotation center $O_1$ of the first rotary portion 410 and a rotation center $O_2$ of the second rotary portion 420 may be matched with each other. In this case, the rotation center of the first rotary portion 410 may indicate a rotation center of the first gear body 415, and the rotation center of the second rotary portion 420 may indicate a rotation center of the second gear body 425.

Referring to FIG. 2, the first fixed portion 430 may include a bottom surface 431 and a first sidewall 433. The second fixed portion 440 may include an upper surface 441 and a second sidewall 443. The second sidewall 443 may be arranged to surround at least a portion of the first sidewall 433. Also, when the first fixed portion 430 and the second fixed portion 440 are coupled with each other, an upper end of the first sidewall 433 may adjoin a lower end of the upper surface 441.

A through hole 445 may be formed in the upper surface 441, and the shaft coupling portion 413 provided in the first rotary portion 410 may pass through the through hole 445.

A plurality of first gear teeth outwardly protruded may be formed at an outer diameter portion of the first gear body 415. The plurality of first gear teeth may be formed radially based on a radius direction of the first gear body 415. Therefore, the plurality of first gear teeth may be rotated based on the rotation center $O_1$ of the first gear body 415. In the shown embodiment, seven first gear teeth may be provided.

A plurality of second gear teeth inwardly protruded may be formed at an inner diameter portion of the second gear body 425. The plurality of second gear teeth may be formed radially based on the center of the second gear body 425. The number of the second gear teeth may be more than the number of the first gear teeth. In the shown embodiment, eight second gear teeth may be provided.

For example, the first gear teeth and the second gear teeth may be formed in a shape corresponding to each other and then engaged with each other. A profile of the first gear teeth and the second gear teeth may be a trochoid shape.

A radius 'b' of a valley of the first gear teeth is smaller than a radius 'd' of a mountain of the second gear teeth. Also, a radius 'a' of a mountain of the first gear teeth is greater than the radius 'd' of the mountain of the second gear teeth and smaller than a radius 'c' of a valley of the second gear teeth.

A center $C_2$ of the second gear body 425 is eccentric with respect to the center $O_2$ of the first rotary portion 410. The eccentric distance is equal to or a little smaller than a difference between the radius 'c' of the valley of the second gear teeth and the radius 'a' of the mountain of the first gear teeth.

Therefore, a space portion 417 may exist between the inner diameter of the second gear body 425 and the outer diameter of the first gear body 415. That is, the space portion 417 may exist between the first gear teeth and the second gear teeth.

A volume of the space portion 417 is more distributed to be close to the center $C_2$ of the second gear body 425 based on the rotation centers $O_1$ and $O_2$. On the contrary, the first gear teeth and the second gear teeth are mutually engaged with each other at a position far away from the center $C_2$ of the second gear body 425 based on the rotation centers $O_1$ and $O_2$.

Since the two rotation centers $O_1$ and $O_2$ are matched with each other, if the rotary shaft 230 is rotated, the first rotary portion 410 and the second rotary portion 420 are concentrically rotated together.

Meanwhile, since the center $C_2$ of the second gear body 425 is eccentric from the rotation center $O_2$ of the second gear body 425, the second gear body 425 orbits based on the rotation center $O_2$. Therefore, the space portion 417 also orbits based on the rotation center $O_2$ of the second gear body 425.

According to such rotation movement, the first gear body 415 and the second gear body 425 are rotated at a constant velocity while the position where the first gear teeth are engaged with the second gear teeth is not changed.

The oil inlet 435 of the first fixed portion 430 exists at a position overlapped with an orbit trace of the space portion 417. Therefore, if the rotary portions 410 and 420 are rotated in a state that the oil inlet 435 and the space portion 417 are overlapped with each other, the oil entering the space portion 417 through the oil inlet 435 orbits together with the rotary portions in a state that the oil is confined in the space portion 417.

The oil chamber 437 also exists at a position overlapped with the orbit trace of the space portion 417. Therefore, the oil moving through the inner space C in a state that the oil is confined in the space portion 417 is dropped to the oil chamber 437 by means of gravity. Since the oil dropped to the oil chamber 437 forcibly enters the oil chamber 437 while having a linear velocity of the space portion 417, the oil filled in the oil chamber 437 is pushed up through the oil outlet 411.

According to the present invention, the oil may be supplied to the oil guide path by rotation of the rotary portions 410 and 420 regardless of a rotation direction of the rotary portions 410 and 420. That is, according to the present invention, the oil may actively be supplied regardless of a rotation direction of the rotary shaft 230.

A first embodiment of the rotary portion provided in the oil supply unit will be described in detail with reference to another drawing.

Figure 4:
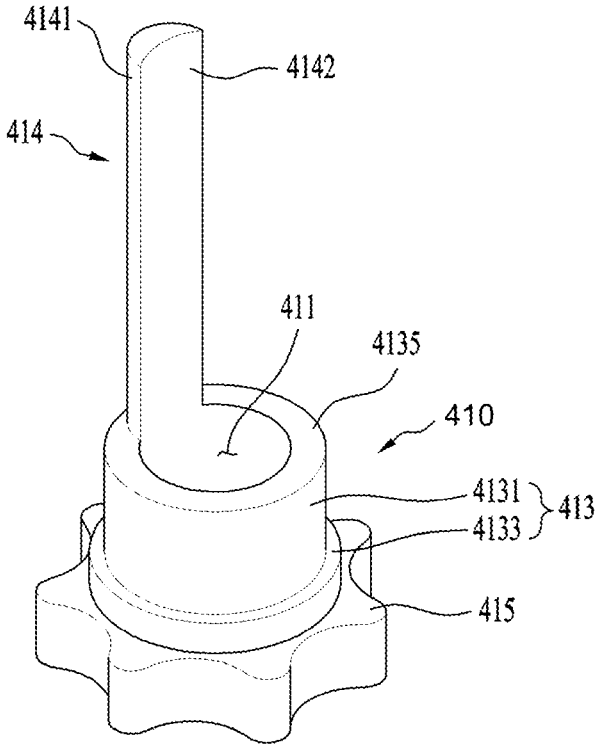
FIG. 4 illustrates a first embodiment of a rotary portion provided in an oil supply unit.

FIG. 4 illustrates a first embodiment of a rotary portion provided in an oil supply unit. In detail, FIG. 4 illustrates a first embodiment of a first rotary portion.

Referring to FIG. 4, the first rotary portion 410 may include a first gear body 415, a shaft coupling portion 413 extended from the upper surface of the first gear body 415 to the upper side, and a first extension portion 414 extended from an upper surface 4135 of the shaft coupling portion 413 to the upper side.

The first gear body 415, the shaft coupling portion 413 and the first extension portion 414 may be formed in a single body.

The oil outlet 411 may be formed at the center in a radius direction of the shaft coupling portion 413 and the first gear body 415. The oil outlet 411 may be extended from the lower end of the first gear body 415 to the upper end of the shaft coupling portion 413. Also, both ends in a length direction of the oil outlet 411 may be opened.

According to this embodiment, the shaft coupling portion 413 may include a pressed portion 4131 pressed in the coupling space S of the aforementioned rotary shaft 230 and a step difference portion 4133 pressed in the through hole 445 of the aforementioned second fixed portion 440. The step difference portion 4133 may be provided at the lower end of the shaft coupling portion 413.

Both the pressurizing portion 4131 and the step difference portion 4133 may be formed in a cylindrical shape. Also, the pressed portion 4131 and the step difference portion 4133 may be formed in a single body. Particularly, the step difference portion 4133 is an element for preventing friction between the lower end of the rotary shaft 230 and the upper surface of the fixed portion from occurring, and will be described later with reference to another drawing.

The first extension portion 414 may be extended from a partial circumference of the upper surface 4135 of the first extension portion 414 to the upper side. Also, the first extension portion 414 may be extended in the same direction as an extension direction of the shaft coupling portion 413 in a state that it is eccentric from the center in a radius direction of the first rotary portion 410.

Referring to FIGS. 1 and 4, the first extension portion 414 may include a first outer circumference surface 4141 of a semi-circle shape, which adjoins an inner circumference surface of the first path 241, and a second outer circumference surface 4142 provided at an opposite side of the first outer circumference surface 4141.

In detail, it is preferable that the first extension portion 414 has a thickness smaller than a diameter of the first path 241. The first outer circumference surface 4141 may adjoin a portion (that is, partial circumference) of the inner circumference surface of the first path 241. Also, the second outer circumference surface 4142 may be arranged to face the other portion of the inner circumference surface of the first path 241.

An oil flow space may be formed between the second outer circumference surface 4142 and the other portion of the inner circumference surface of the first path 241, and oil may be guided through the oil flow space. Therefore, according to the present invention, the slip between the rotary shaft 230 and the first rotary portion 410 may be avoided and at the same time the oil may stably be supplied.

In more detail, the second outer circumference surface 4142 may be formed to be recessed toward the first outer circumference surface 4141. Also, the second outer circumference surface 4142 may be formed to be curved at a preset curvature. Therefore, when the oil is guided along the second outer circumference surface 4142, flow resistance may be reduced.

The curvature of the second outer circumference surface 4142 is smaller than that of the first outer circumference surface 4141. This is to allow the first outer circumference surface 4141 to adjoin the inner circumference surface of the first path 241 and at the same time guide oil through the second outer circumference surface 4142.

Meanwhile, the first path 241 may be provided with a divergence path 245 for guiding oil toward a bearing 315 that supports the rotary shaft 230. That is, the divergence path 245 may be diverged from the first path 241.

For example, the divergence path 245 may be provided at a height of a middle length or more of the first path 241. The upper end of the first extension portion 414 may be arranged below the divergence path 245. This is to prevent the divergence path 245 from being blocked by the first extension portion 414 and at the same time insert the first extension portion 414 into the first path 241 if possible.

Figure 5:
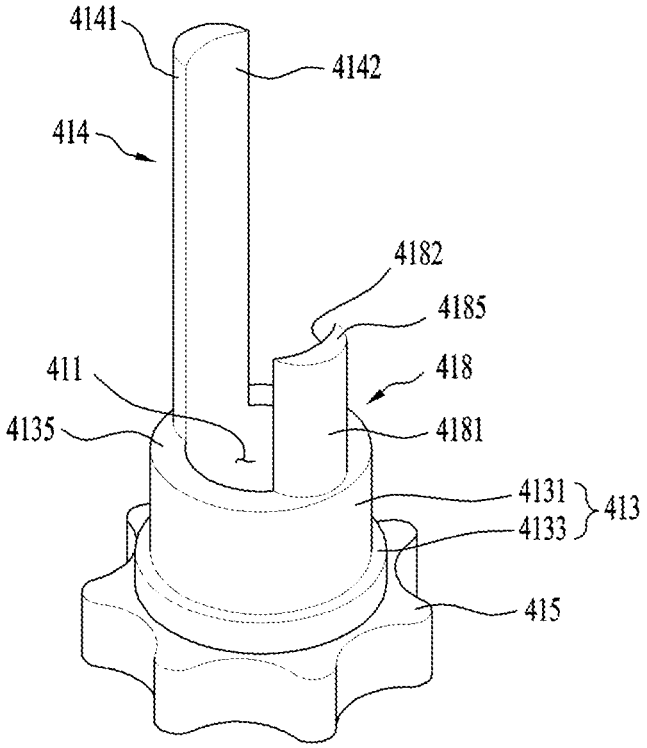
FIG. 5 illustrates a second embodiment of a rotary portion provided in an oil supply unit.
Figure 6:
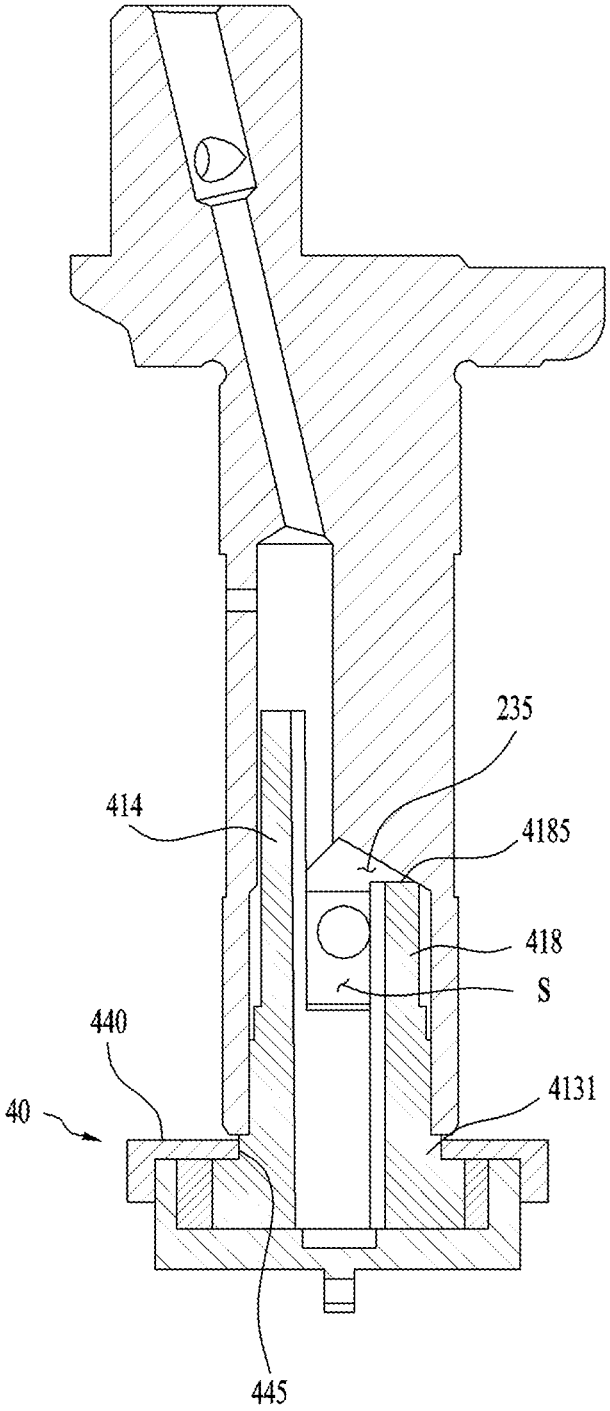
FIG. 6 is a sectional view illustrating a state that a rotary portion according to the second embodiment is coupled to a rotary shaft.

FIG. 5 illustrates a second embodiment of a rotary portion (that is, first rotary portion) provided in an oil supply unit, and FIG. 6 is a sectional view illustrating a state that a rotary portion according to the second embodiment is coupled to a rotary shaft.

Hereinafter, elements of the first rotary portion according to the second embodiment will be described based on a difference from the elements of the rotary portion according to the first embodiment.

Referring to FIGS. 5 and 6, the first rotary portion 410 according to this embodiment may further include a second extension portion 418 provided independently from the first extension portion 414. The second extension portion 418 is an element for determining a pressed depth of the shaft coupling portion 413 pressed into the inner side of the coupling space S.

In detail, the second extension portion 418 may be arranged to be spaced apart from the first extension portion 414. For example, the second extension portion 418 may be arranged to face the first extension portion 414. That is, the first extension portion 414 and the second extension portion 418 may be spaced apart from each other as much as a diameter of the oil outlet 411.

An upper end 4185 of the second extension portion 418 may adjoin the upper surface 235 of the coupling space S. Therefore, the pressed depth of the shaft coupling portion 413 for the coupling space S may be determined by the second extension portion 418.

The step difference portion 4133 is an element for preventing friction between the lower end of the rotary shaft 230 and the upper end (that is, upper surface of the second fixed portion 440) of the fixed portions 430 and 440 from occurring. Hereinafter, the step difference portion 4133 will be described in more detail with reference to another drawing.

Figure 7:
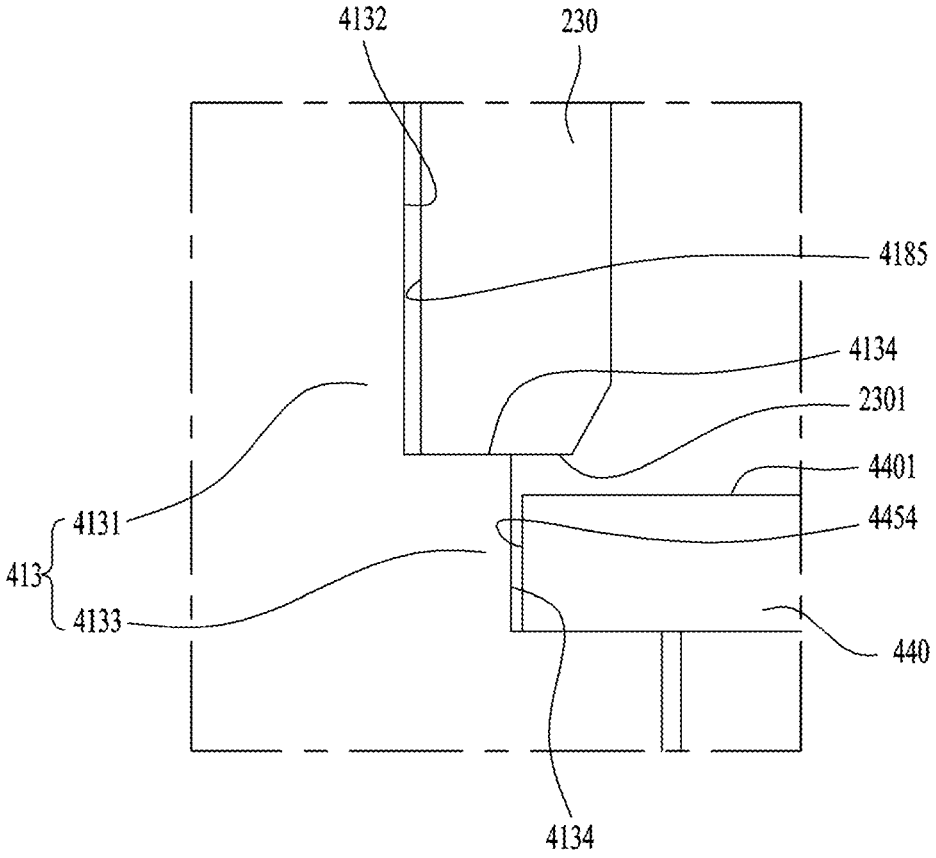
FIG. 7 is a view illustrating a coupling relation between a rotary shaft and an oil supply unit.

FIG. 7 is a view illustrating a coupling relation between a rotary shaft and an oil supply unit.

Referring to FIG. 7, the step difference portion 4133 protruded at the outside in a radius direction of the coupling portion 413 may be provide at the lower end of the coupling portion 413. That is, the step difference portion 4133 may be formed to be protruded from the lower end of the pressed portion 4131 to the outside in a radius direction of the pressed portion 4131.

The outer circumference surface of the pressed portion 4131 may face the inner circumference surface (that is, inner circumference surface of the base shaft 231) of the rotary shaft 230. That is, the outer circumference surface of the pressed portion 4131 may face the inner circumference surface of the hollow base shaft 231.

In this case, the inner circumference surface of the base shaft 231 may mean a lateral circumference partitioning the coupling space S.

A side 4134 of the step difference portion 4133 may face an inner circumference surface 4454 of the aforementioned through hole 445. That is, the side 4134 of the step difference portion 4133 and the inner circumference surface 4454 of the through hole 445 may face each other.

Also, the step difference portion 4133 may be pressed in the through hole 445 by passing through the through hole 445. The lower end 2301 of the rotary shaft 230 may adjoin the upper surface 4134 of the step difference portion 4133. In this case, the lower end of the rotary shaft 230 may mean the lower end of the base shaft 231.

The step difference portion 4133 may have a height greater than a thickness of the upper surface of the second fixed portion. That is, the upper surface 4134 of the step difference portion 4133 may be arranged to be higher than the upper surface 4401 of the second fixed portion 440.

Therefore, even though the rotary shaft 230 is rotated, friction between the rotary shaft 230 and the upper end (that is, upper surface of the second fixed portion 440) of the fixed portion may be avoided.

It will be apparent to those skilled in the art that the present invention may be embodied in other specific forms without departing from the spirit and essential characteristics of the invention. Thus, the above embodiments are to be considered in all respects as illustrative and not restrictive. The scope of the invention should be determined by reasonable interpretation of the appended claims and all changes which come within the equivalent scope of the invention are included in the scope of the invention.

What is claimed is:

1. A compressor comprising:

a driving unit comprising a stator, a rotor, and a rotary shaft disposed in the rotor, the driving unit defining an oil guide path disposed at an inner side of the rotary shaft in a radius direction of the rotary shaft;

a compression unit coupled to the rotary shaft, the compression unit comprising a cylinder and a piston that is configured to reciprocate in the cylinder based on a driving force generated by the driving unit; and an oil supply unit coupled to a lower end of the rotary shaft and configured to supply oil toward the compression unit, the oil supply unit comprising:

a rotary portion configured to supply oil toward the oil guide path based on rotating together with the rotary shaft, and a fixed portion that defines an inner space that accommodates at least a portion of the rotary portion, wherein at least a portion of the oil guide path passes through the rotary shaft along a length direction of the rotary shaft, wherein the oil guide path comprises:

a first path that extends toward an upper side of the rotary shaft, the first path being eccentric from a center of the rotary shaft in the radius direction, and a second path that extends from the first path to an upper end of the rotary shaft and that is inclined toward the piston with respect to the first path, wherein the rotary shaft defines a coupling space that extends in the radius direction from the inner side of the rotary shaft, the coupling space being defined at the lower end of the rotary shaft and receiving a portion of the rotary portion, and wherein the rotary portion comprises a shaft coupling portion that is pressed into the coupling space and a first extension portion that is received in the first path through the coupling space.

2. The compressor of claim 1, wherein the coupling space is recessed upward from the lower end of the rotary shaft, and wherein the first path extends from the coupling space toward the upper side of the rotary shaft.

3. The compressor of claim 2, wherein the rotary shaft comprises:

a base shaft connected to the rotor;

a rotary plate disposed at an upper side of the base shaft; and an eccentric shaft disposed at an upper side of the rotary plate, a center of the eccentric shaft being offset from a center of the base shaft in the radius direction of the rotary shaft, and wherein the compression unit further comprises a connecting rod that connects the piston and the eccentric shaft to each other.

4. The compressor of claim 3, wherein the coupling space and the first path are defined in an inside of the base shaft and extend along the length direction of the rotary shaft.

5. The compressor of claim 3, wherein the second path passes through an inside of the eccentric shaft and the rotary plate in a direction inclined with respect to the first path.

6. The compressor of claim 5, wherein the eccentric shaft defines an oil discharge hole at an upper end of the eccentric shaft, the oil discharge hole being configured to communicate with the second path.

7. The compressor of claim 5, wherein the second path comprises:

a lower path that extends from an upper end of the first path and has a first diameter less than a diameter of the first path; and an upper path that extends from an upper end of the lower path and has a second diameter greater than the first diameter of the lower path.

8. The compressor of claim 1, wherein the first extension portion is disposed at a position eccentric from the center of the rotary shaft in the radius direction of the rotary portion.

9. The compressor of claim 1, wherein the first extension portion comprises:

a first outer circumference surface having a semi-circle shape, the first outer circumference surface facing a first portion of an inner circumference surface of the first path; and a second outer circumference surface disposed at an opposite side of the first outer circumference surface, the second outer circumference surface facing a second portion of the inner circumference surface of the first path.

10. The compressor of claim 9, wherein the second outer circumference surface is recessed toward the first outer circumference surface.

11. The compressor of claim 10, wherein a curvature of the second outer circumference surface is less than a curvature of the first outer circumference surface.

12. The compressor of claim 1, wherein the first path defines a divergence path configured to guide oil toward a bearing that supports the rotary shaft.

13. The compressor of claim 12, wherein the divergence path is branched from a middle position of the first path in the length direction of the rotary shaft or at a position vertically above the middle position of the first path, and wherein an upper end of the first extension portion is arranged vertically below the divergence path.

14. The compressor of claim 1, wherein the rotary portion further comprises:

a second extension portion that is spaced apart from the first extension portion and that extends from the upper end of the shaft coupling portion through an inner side of the coupling space, and wherein an upper end of the second extension portion contacts an upper surface of the coupling space.

15. The compressor of claim 14, wherein the second extension portion faces the first extension portion in the radius direction of the rotary shaft.

16. The compressor of claim 1, wherein the fixed portion defines a through hole that receives the shaft coupling portion, wherein the shaft coupling portion comprises a step difference portion that protrudes from a lower end of the shaft coupling portion outward in the radius direction of the rotary shaft, the step different portion being inserted in the through hole, and wherein an upper surface of the step difference portion is configured to support the lower end of the rotary shaft.

17. The compressor of claim 16, wherein a side surface of the step difference portion faces an inner circumference surface of the through hole.

18. The compressor of claim 16, wherein the rotary portion comprises:

a first rotary portion disposed at a lower side of the step difference portion, the first rotary portion comprising a first gear body; and a second rotary portion that surrounds an outer side of the first rotary portion, the second rotary portion comprising a second gear body configured to engage with the first gear body, wherein the fixed portion comprises:

a first fixed portion that defines the through hole, and a second fixed portion that is coupled to the first fixed portion and that defines an inner space configured to accommodate the first rotary portion and the second rotary portion, and wherein the second fixed portion defines:

an oil inlet that passes through a bottom surface of the second fixed portion in an up-down direction and configured to receive oil, and an oil chamber configured to guide, toward an inner side of the shaft coupling portion, oil that is received through the oil inlet and that is pressed between the first gear body and the second gear body.

19. The compressor of claim 18, wherein the first gear body comprises first gear teeth having a first trochoid shape, wherein the second gear body comprises second gear teeth that face the first gear teeth, the second gear teeth having a second trochoid shape, and wherein the first gear teeth and the second gear teeth define a gear space portion therebetween that is configured to communicate with the oil inlet.

20. The compressor of claim 1, wherein an outer circumferential surface of the shaft coupling portion is in contact with the inner side of the rotary shaft that surrounds the coupling space, and wherein the first path extends from the coupling space to the second path.

* * * * *